US007698871B2

(12) United States Patent
Mansueto et al.

(10) Patent No.: US 7,698,871 B2
(45) Date of Patent: Apr. 20, 2010

(54) CLOSURE FRAME CORNER JOINT

(75) Inventors: Richard Mansueto, Gig Harbor, WA (US); Jess Valler, Olympia, WA (US)

(73) Assignee: Milgard Manufacturing, Inc., Tacoma, WA (US)

( * ) Notice: Subject to any disclaimer, the term of this patent is extended or adjusted under 35 U.S.C. 154(b) by 0 days.

(21) Appl. No.: 12/235,702

(22) Filed: Sep. 23, 2008

(65) Prior Publication Data

US 2010/0071303 A1 Mar. 25, 2010

(51) Int. Cl.
*E04C 2/38* (2006.01)

(52) U.S. Cl. ..... 52/656.9; 52/656.7

(58) Field of Classification Search ..... 52/656.9, 52/656.7, 127.7, 127.12, 656.4, 656.5, 656.6, 52/656.2, 456; 403/187, 205, 252, 255, 258, 403/259, 292, 294, 295, 331, 382, 403, 231
See application file for complete search history.

(56) References Cited

U.S. PATENT DOCUMENTS

| | | | | | |
|---|---|---|---|---|---|
| 1,961,006 | A * | 5/1934 | Marty | 52/800.16 |
| 2,634,525 | A * | 4/1953 | Levine | 38/77.6 |
| 2,727,595 | A * | 12/1955 | Beltman | 52/364 |
| 2,970,677 | A * | 2/1961 | Springs, Jr. et al. | 52/769 |
| 3,017,970 | A * | 1/1962 | Nickols | 52/127.12 |
| 3,299,596 | A * | 1/1967 | Neal et al. | 52/476 |
| 3,357,661 | A * | 12/1967 | Aakjar | 248/662 |
| 3,375,030 | A * | 3/1968 | Thompson | 403/231 |
| 3,574,378 | A * | 4/1971 | Heywood | 403/231 |
| 3,915,579 | A * | 10/1975 | Offenbroich | 403/264 |
| 4,109,429 | A * | 8/1978 | Whisson | 52/126.4 |
| 4,665,663 | A * | 5/1987 | Governale | 52/456 |
| 5,261,203 | A * | 11/1993 | Yoon | 52/455 |
| 5,363,625 | A * | 11/1994 | Philippi | 52/653.2 |
| 5,653,074 | A * | 8/1997 | Yoon | 52/210 |
| 5,655,348 | A * | 8/1997 | Paradise | 52/656.4 |
| 5,875,600 | A * | 3/1999 | Redman | 52/656.4 |
| 7,077,263 | B1 * | 7/2006 | Richardson et al. | 198/844.2 |
| 7,216,855 | B2 * | 5/2007 | Platt | 256/65.03 |
| 2006/0048476 | A1 * | 3/2006 | Krapf et al. | 52/656.9 |
| 2008/0159806 | A1 * | 7/2008 | Niswonger | 403/231 |

FOREIGN PATENT DOCUMENTS

| | | | |
|---|---|---|---|
| DE | 2646351 | A * | 5/1977 |
| GB | 2134205 | A * | 8/1984 |

* cited by examiner

*Primary Examiner*—Robert J Canfield
*Assistant Examiner*—Babajide Demuren
(74) *Attorney, Agent, or Firm*—Reising Ethington PC

(57) ABSTRACT

A closure frame includes at least one end rail, at least one side rail and a corner joint between ends of the corner and side rails. The corner joint includes a rail insert secured within a first of the rails. A threaded fastener is secured against rotation within the insert and extends from an open end of the first rail into a second of the rails. A nut is disposed within the second rail in threaded engagement with the end of the fastener and clamps the second rail against the open end of the first rail. The corner joint preferably is a butt joint, and a pair of rail inserts preferably are disposed within the end of the first rail so that a pair of threaded fasteners extend into the second rail and are engaged by associated nuts in the second rail. A washer plate preferably is disposed in the second rail beneath the nuts, and a gasket preferably is disposed between the second rail and the open end of the first rail to seal the corner joint.

12 Claims, 2 Drawing Sheets

CLOSURE FRAME CORNER JOINT

The present disclosure relates to building closure assemblies such as windows and doors, and more particularly to a frame corner joint for such a closure assembly.

BACKGROUND AND SUMMARY OF THE DISCLOSURE

Building closure assemblies of current design, such as patio screens and doors, typically require several screws to form a butt joint at each corner of the frame. Alignment and assembly at the four corners of the frame can be a laborious and costly operation. It is a general object of the present disclosure to provide a corner joint, preferably a corner butt joint, for a building closure frame that can be economically fabricated.

The present disclosure embodies a number of aspects that can be implemented separately from or in combination with each other.

A closure frame in accordance with one aspect of the present disclosure includes at least one end rail, at least one side rail and a corner joint between ends of the corner and side rails. The corner joint includes a rail insert secured within a first of the rails. A threaded fastener is secured against rotation within the insert and extends from an open end of the first rail into a second of the rails. A nut is disposed within the second rail in threaded engagement with the end of the fastener and clamps the second rail against the open end of the first rail. The corner joint preferably is a butt joint, and a pair of rail inserts preferably are disposed within the end of the first rail so that a pair of threaded fasteners extend into the second rail and are engaged by associated nuts in the second rail. A washer plate preferably is disposed in the second rail beneath the nuts, and a gasket preferably is disposed between the second rail and the open end of the first rail to seal the corner joint.

BRIEF DESCRIPTION OF THE DRAWINGS

The disclosure, together with additional objects, features, advantages and aspects thereof, will best be understood from the following description, the appended claims and the accompanying drawings, in which:

DETAILED DESCRIPTION OF PREFERRED EMBODIMENTS

Figure 1:
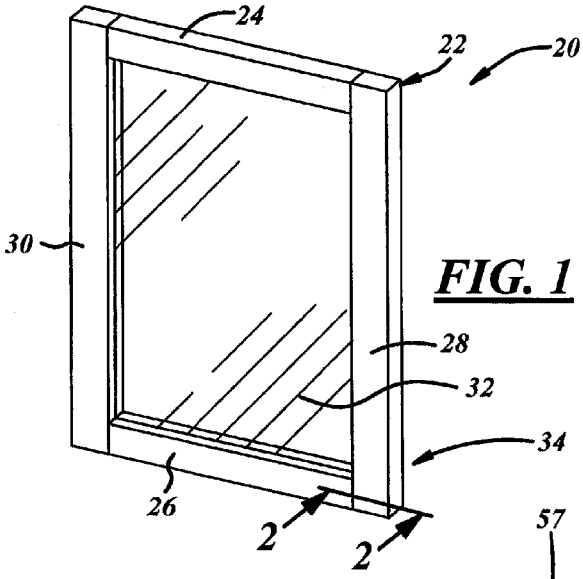
FIG. 1 is a perspective view of a closure assembly that includes a closure frame in accordance with an exemplary embodiment of the present disclosure.

FIG. 1 illustrates a building closure 20 in the form of a patio door in accordance with an exemplary embodiment of the present disclosure. Closure 20 includes a rectangular frame 22 having a pair of end rails 24, 26 and a pair of stiles or side rails 28, 30. A glass or plastic pane 32 is illustrated within frame 22. Rectangular frame 22 has a butt joint at each corner of the frame, with joint 34 at the lower right corner of FIG. 1 being illustrated in detail in FIGS. 2-3. All of the corner joints preferably are identical.

Figure 5:
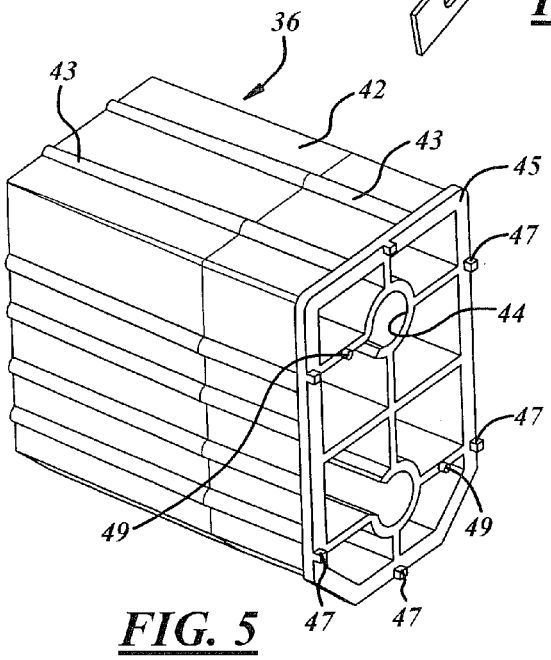
FIG. 5 is a front perspective view of the rail insert in FIG. 4.
Figure 4:
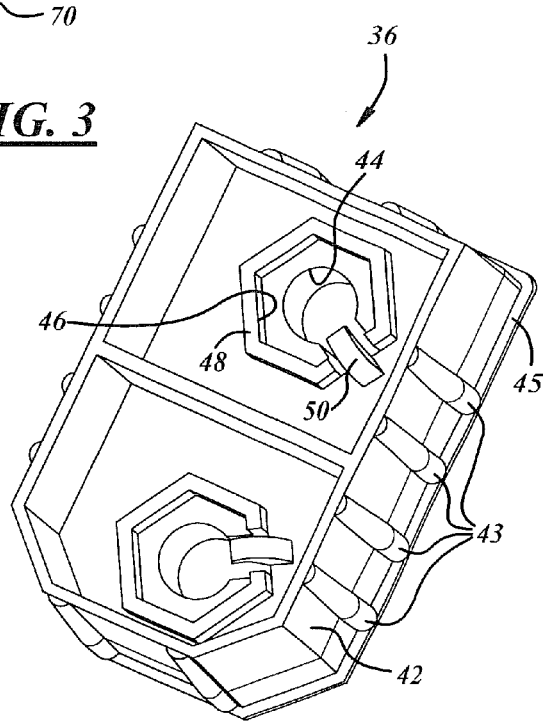
FIG. 4 is a rear perspective view of a rail insert in the corner joint illustrated in FIGS. 2 and 3.

Frame corner butt joint 34 includes at least one rail insert 36, preferably a pair of rail inserts 36 received within associated hollow chambers 38, 40 at the open end of rail 26. Rails 24-30 preferably are of extruded construction such as metal or plastic. Insert 36 preferably is of molded plastic or metal construction having a periphery 42 generally conforming to the geometry of the chamber 38 or 40 (preferably having identical geometries) into which the insert is to be placed. A plurality of spaced parallel ribs 43 extend along the sides of the insert periphery and radially outwardly from the periphery. There is an outwardly extending flange 45 around the front face of insert 36. A plurality of pegs 47, 49 extend axially from flange 45 and from the front face of the insert. Each insert 36 has at least one through-opening 44 that extends from the front face of the insert (FIG. 5) to the back face (FIG. 4). Outer pegs 47 around the perimeter of insert 36 are for indicating the depth of press fit of the inserts into the rail. Inner pegs 49 allow for alignment of gasket 68, if needed. There are two through-openings 44 in each insert to allow the bolt to be installed in either or both openings. The back face of the insert is recessed to facilitate molding and to provide a good lead-in for assembly purposes.

Figure 2:
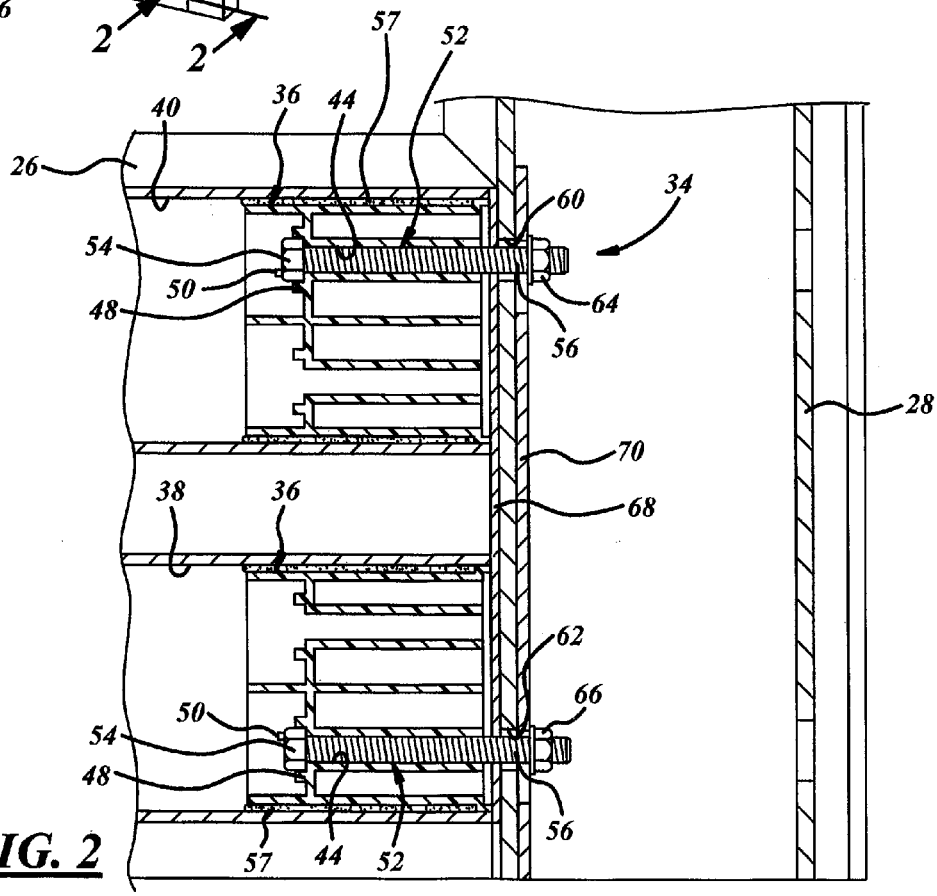
FIG. 2 is a fragmentary sectional view taken substantially along the line 2-2 in FIG. 1.
Figure 3:
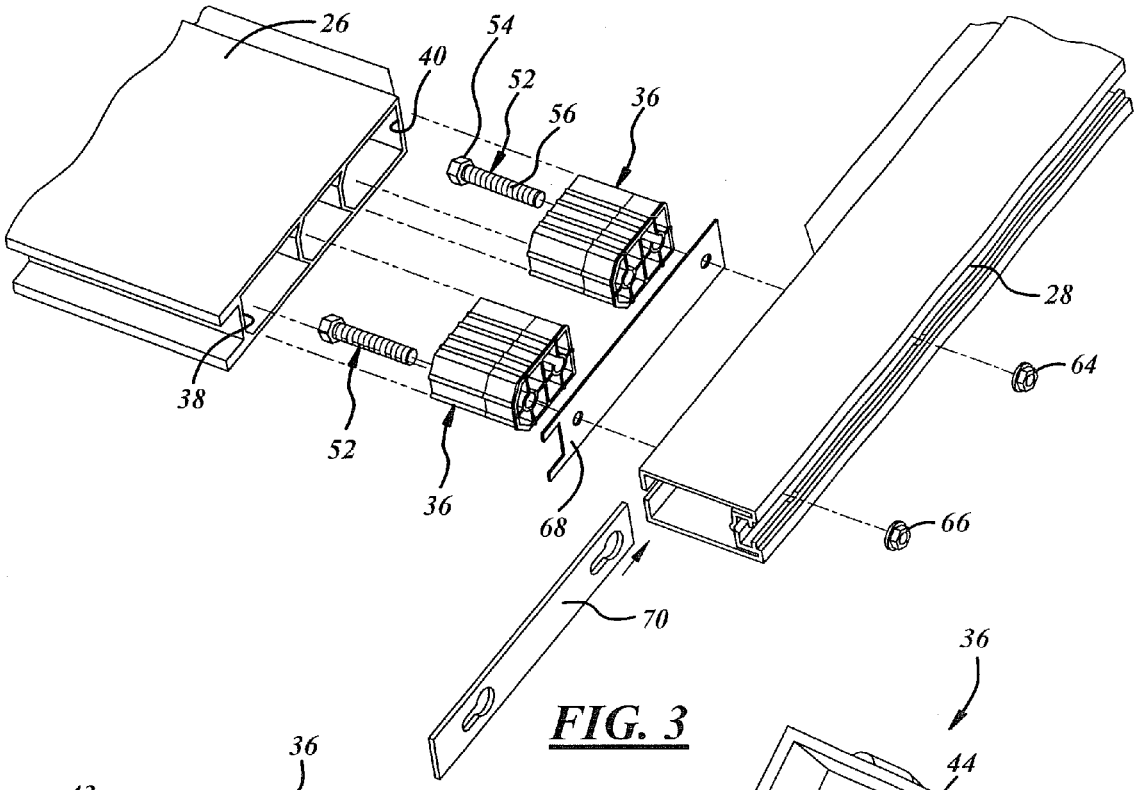
FIG. 3 is an exploded perspective view of the frame corner joint illustrated in FIG. 2.

The back face of insert 44 has a pocket 46 around through-opening 44. Pocket 46 preferably is non-circular, such as hexagonal as best seen in FIG. 4. This hexagonal pocket 46 preferably is formed by a hexagonal wall 48 upstanding from the back face of the insert surrounding and coaxial with through-opening 44. A finger 50 extends from the back face of the insert and partially overlies pocket 46 for purposes to be described. Wall 48 can be interrupted at finger 50, as best seen in FIG. 4. FIGS. 2-4 illustrate inserts 36 each having a pair of through-openings 44 and associated recesses 46. Only one of these through-openings and recesses in each insert is employed in the exemplary embodiment of the disclosure.

A threaded fastener 52 is carried by each insert 36. Fastener 52 preferably comprises a standard hex-head bolt having a head 54 non-rotatably captured within pocket 46 of insert 36, and a threaded shank 56 that extends through insert through-opening 44 and outwardly from the front face of the insert. Finger 50 of insert 36 extends over and captures head 54 of bolt 52 within pocket 46, while the preferred hexagonal geometries of head 54 and pocket 46 prevent rotation of bolt 52 with respect to insert 36.

The assembly of bolt 52 and insert 36 is then secured within chamber 38 or 40 of rail 26, preferably by applying a layer 57 of adhesive 57 to the external periphery 42 of insert 36 prior to insertion of the insert into the end of the rail. Ribs 43 are press-fitted into the rail chamber and the adhesive is disposed between the ribs. Flange 45 seals the end of chamber 38 or 40 and helps prevent leakage of adhesive. The threaded ends of bolts 52 extend from the open end of rail 26.

Side rail or stile 28 is then assembled against the open end of rail 26. This is accomplished by placing openings 60, 62 (FIG. 2) of rail 28 over the threaded ends of shanks 56. Nuts 64, 66 are then threaded onto the ends of bolts 52 firmly to clamp side rail 28 against the open end of end rail 26. A gasket 68 preferably is placed between the open end of rail 26 and the opposing face of rail 28 to the seal the joint against leakage. A washer plate 70 preferably is inserted into the end of rail 28 and located beneath nuts 64, 66.

There thus has been disclosed a closure frame, and particularly a closure frame corner joint, that fully satisfies all of the objects and aims previously set forth. The present disclosure has been presented in conjunction with an exemplary embodiment, and additional modifications and variations have been discussed. Other modifications and variations readily will suggest themselves to persons of ordinary skill in the art in view of the foregoing description. For example, the disclosure is by no means limited to corner butt joints but could be implemented in conjunction with corner mitered joints, for example. Nor is the disclosure limited specifically to door-frames, or to rectangular frames. For example, the disclosure could be implemented in conjunction with part-circular decorative windows. The disclosure is intended to embrace all such modifications and variations as fall within the spirit and broad scope of the appended claims.

The invention claimed is:

1. A closure frame that includes at least one end rail, at least one side rail and a corner joint between said end rail and said side rail, said corner joint including:

a rail insert received within a first of said rails, a threaded fastener secured against rotation within said insert and extending from an open end of said first rail into said second rail, and a nut within said second rail threadably engaging said end of said fastener and clamping said second rail against said open end of said first rail, wherein said threaded fastener has a non-circular head, said insert has a non-circular pocket in which said head is disposed so that said head is non-rotatable in said pocket, and said insert includes a finger capturing said head within said pocket.

2. The closure frame set forth in claim 1 including a washer within said second rail beneath said nut.

3. The closure frame set forth in claim 2 including a gasket between said open end of said first rail and an outside surface of said second rail.

4. The closure frame set forth in claim 1 wherein said insert is secured within said first rail by an adhesive.

5. The closures frame set forth in claim 1 wherein said head and said pocket are of hexagonal geometry.

6. The closure frame set forth in claim 1 wherein said first rail has at least two hollow chambers adjacent to said open end, wherein a pair of said rail inserts are respectively secured within said chambers, each of said inserts having an associated threaded fastener secured against rotation with respect to said insert and extending from said open end, and wherein said second rail is hollow and a pair of said nuts are disposed within said second rail in threaded engagement with said fasteners.

7. A closure frame that includes at least one end rail, at least one side rail and a butt corner joint between said end rail and said side rail, said butt corner joint including:

a rail insert secured within said end rail, said rail insert having a non-circular pocket, a through passage extending from said pocket and a finger overlying said pocket, a threaded fastener having a non-circular head disposed in said pocket and held in said pocket by said finger against rotation with respect to said insert, and a threaded shank extending through said through-opening from an open end of said end rail into said side rail, and a nut disposed within said side rail threadably engaging said threaded shank and clamping said side rail against said open end of said end rail.

8. The closure frame set forth in claim 7 wherein said pocket and said head are of hexagonal geometry.

9. The closure frame set forth in claim 8 wherein said insert is secured within said end rail by an adhesive.

10. The closure frame set forth in claim 9 including a washer plate disposed within said side rail beneath said nuts.

11. The closure frame set forth in claim 10 including a gasket between said open end of said end rail and an outside surface of said side rail.

12. The closure frame set forth in claim 9 wherein said end rail has at least two hollow chambers adjacent to said open end, wherein a pair of said rail inserts are respectively disposed within said chambers, each of said inserts having an associated one of said threaded fasteners secured against rotation within said insert and extending from said open end, and wherein said side rail is hollow and a pair of said nuts are disposed within said side rail in threaded engagement with respective ones of said fasteners clamping said side rail to said end of said end rail.

* * * * *